United States Patent [19]

Matsui et al.

[11] Patent Number: 4,842,796

[45] Date of Patent: Jun. 27, 1989

[54] PROCESS FOR PRODUCING HIGH STRENGTH POLYMETAPHENYLENE ISOPHTHALAMIDE FIBER

[75] Inventors: Hideo Matsui; Hiroshi Fujie, both of Iwakuni, Japan

[73] Assignee: Teijin Limited, Osaka, Japan

[21] Appl. No.: 133,175

[22] Filed: Dec. 11, 1987

Related U.S. Application Data

[62] Division of Ser. No. 937,341, Dec. 3, 1986, abandoned.

[30] Foreign Application Priority Data

Dec. 11, 1985 [JP] Japan ..... 60-276934

[51] Int. Cl.[4] ..... D01F 6/60; D01D 5/12; D01D 10/06

[52] U.S. Cl. ..... 264/184; 264/203; 264/210.2; 264/210.7; 264/210.8; 264/211.15; 264/211.16; 264/233; 264/210.3

[58] Field of Search ..... 264/203, 184, 210.3, 264/233, 210.2, 210.7, 210.8, 211.15, 211.16

[56] References Cited

U.S. PATENT DOCUMENTS

| | | | |
|---|---|---|---|
| 3,006,899 | 10/1961 | Hill et al. | 528/348 X |
| 3,079,219 | 2/1963 | King | 528/348 X |
| 3,094,511 | 6/1963 | Hill et al. | 528/348 |
| 3,287,324 | 11/1966 | Sweeny | 528/348 |
| 3,300,450 | 1/1967 | Clay | 528/348 |
| 3,414,645 | 12/1968 | Morgan, Jr. | 264/203 |
| 3,560,137 | 2/1971 | Hahn | 528/348 X |
| 3,642,706 | 2/1972 | Morgan, Jr. | 264/184 |
| 3,751,546 | 8/1973 | Horoldt | 528/348 X |
| 3,869,429 | 3/1975 | Blades | 264/203 |
| 4,073,837 | 2/1978 | Kouzai et al. | 264/184 |
| 4,342,715 | 8/1982 | Shimada et al. | 264/184 |
| 4,374,978 | 2/1983 | Fujiwara et al. | 264/184 |

FOREIGN PATENT DOCUMENTS

| | | | |
|---|---|---|---|
| 0229395 | 8/1958 | Australia | 528/348 |
| 1482822 | 6/1965 | France . | |

*Primary Examiner*—Hubert Lorin

*Attorney, Agent, or Firm*—Burgess, Ryan & Wayne

[57] ABSTRACT

A process is provided for preparing high strength polymetaphenylene isophthalamide fibers by the steps which include extruding a dope solution of a metaphenylene isophthalamide polymer in an organic solvent through a spinneret and into a coagulating liquid form in undrawn polymer filament; adjusting the content of the organic solvent; carrying out a first wet drawing in at least one aqueous wet drawing bath; making a second adjustment of the content of the organic solvent; carrying out a second wet drawing at a specified draw ratio in at least one aqueous wet drawing bath; drying the second wet drawn filament; and dry drawing the dried filament.

16 Claims, 1 Drawing Sheet

PROCESS FOR PRODUCING HIGH STRENGTH POLYMETAPHENYLENE ISOPHTHALAMIDE FIBER

This application is a division of application Ser. No. 937,341 filed Dec. 3, 1986 now abandoned.

BACKGROUND OF THE INVENTION

1. Field of the Invention

The present invention relates to a high strength poly-m-phenylene isophthalamide fiber and a process for producing the same. More particularly, the present invention relates to a new type of poly-m-phenylene isophthalamide fiber having a much higher tensile strength than that of conventional poly-m-phenylene isophthalamide fibers, and a new process for producing the same.

2. Description of the Related Art

It is well known from, for example, U.S. Pat. Nos. 3,287,324, 3,300,450, 3,560,137 and 4,073,837, that conventional poly-m-phenylene isophthalamide fibers, which are available under a registered trademark of TEIJINCONEX or NOMEX, exhibit an excellent heat-resistance and a superior flame-resistance, and are utilized in various fields, for example, clothing and industrial materials.

It is also known, however, that the conventional poly-m-phenylene isophthalamide fibers have a relatively low mechanical strength, for example, a tensile strength of about 5.5 g/denier or less, and therefore, utilization of the fibers is restricted in specific fields in which the fibers are required to exhibit a very high mechanical strength, for example, reinforcing fibrous materials for rubber products and synthetic resinous products, and substrate cloth for bag filter felts.

To eliminate the disadvantages of the conventional poly-m-phenylene isophthalamide fibers, poly-p-phenylene terephthalamide fibers are provided. The poly-p-phenylene terephthalamide fibers exhibit a very high mechanical strength, for example a tensile strength of about 20 g/denier or more. These poly-p-phenylene terephthalate fibers, however, can be produced only at a very high cost, and exhibit a very small ultimate elongation of about 5% or less. Accordingly, the poly-p-phenylene terephthalamide fibers are not usable in fields in which the fibers are required to have an ultimate elongation of more than about 5%. Also, the poly-p-phenylene terephthalamide fibers are disadvantageous in that fibrillation thereof is easily caused.

SUMMARY OF THE INVENTION

An object of the present invention is to provide a high strength poly-m-phenylene isophthalamide fiber having a higher tensile strength than that of conventional poly-m-phenylene isophthalamide fibers, that is, 6.5 g/denier or more, and a process for producing the same.

The above-mentioned object is attained by the high strength poly-m-phenylene isophthalamide fiber of the present invention and the process of the present invention for producing the above-mentioned fiber.

The high strength poly-m-phenylene isophthalamide fiber of the present invention comprises an m-phenylene isophthalamide polymer containing at least 95 molar % of recurring m-phenylene isophthalamide units and having an intrinsic viscosity ([$\eta$]) of from 0.7 to 2.5, determined at a concentration of 0.5 g/100 ml in dehydrated N-methyl-2-pyrrolidone at a temperature of 30° C., and has a birefringence of from 0.18 to 0.22, a degree of crystallinity of from 45% to 55%, a crystalline size of from 35 to 45 angstroms (Å), a tensile strength of 6.5 g/denier or more, and a silk factor of 35 or more.

The process of the present invention for producing a high strength poly-m-phenylene isophthalamide fiber having a birefringence of from 0.18 to 0.22, a degree of crystallinity of from 45% to 55%, a crystalline size of from 35 to 45 angstroms, a tensile strength of 6.5 g/denier or more, and a silk factor of 35 or more, comprises the operations of extruding a dope solution of an m-phenylene isophthalamide polymer containing at least 95 molar % of recurring m-phenylene isophthalate units and having an intrinsic viscosity ([$\eta$]) of from 0.7 to 2.5, determined at a concentration of 0.5 g/100 ml in dehydrated N-methyl-2-pyrrolidone at a temperature of 30° C., in an organic solvent through a spinneret having at least one spinning orifice, into a coagulating liquid to form at least one undrawn polymer filament; first adjusting the content of the organic solvent in the undrawn filament to a level of 15 to 30% based on the weight of the polymer in the filament; first wet drawing the first adjusted filament at a draw ratio of 1.1 to 1.5; second organic solvent content-adjusting the content of the organic solvent in the filament to a level of less than 15% based on the weight of the polymer in the filament; second wet drawing the second organic solvent content-adjusted filament at a draw ratio of 1.1 or more; drying the second wet drawn filament; and dry drawing the dried filament to an extent such that the entire draw ratio in the first and second wet drawing and dry drawing operations is in the range of from 4.0×7.0.

DESCRIPTION OF THE PREFERRED EMBODIMENTS

Figure 1:
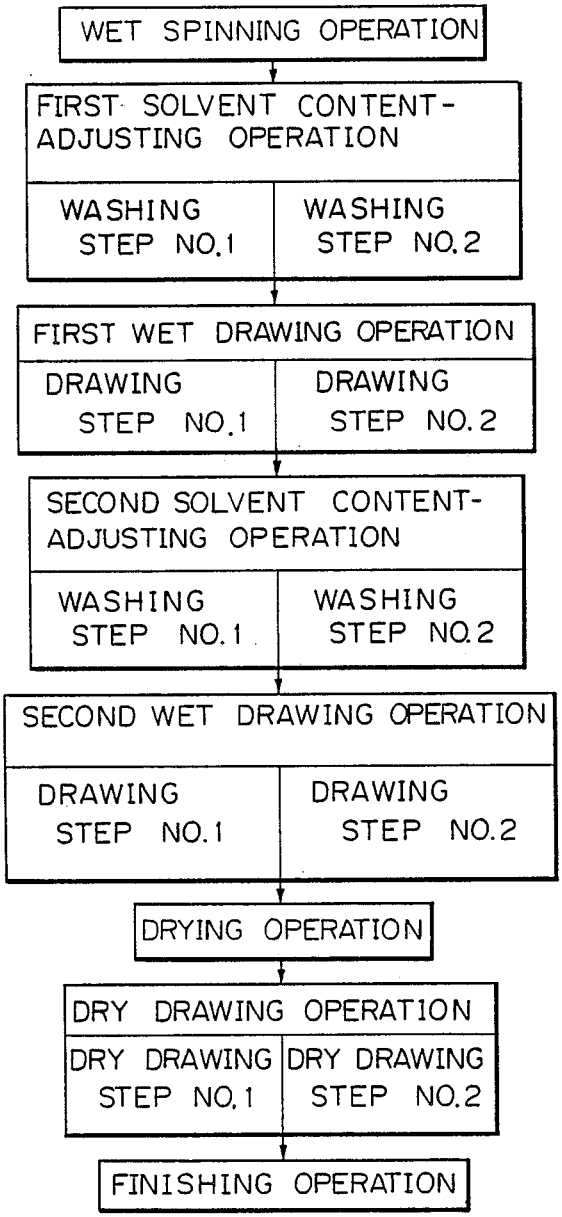
FIG. 1 is a flow sheet of an embodiment of the process of the present invention.

In the high strength poly-m-phenylene isophthalate fiber of the present invention, it is important that the fiber consists of a specific m-phenylene isophthalamide polymer containing 95 molar % or more of recurring m-phenylene isophthalamide units and having an intrinsic viscosity ([$\eta$]) in a specific range of from 0.7 to 2.5, and exhibits a significantly enhanced molecular orientation represented by a birefringence of from 0.18 to 0.22, an increased degree of crystallinity of 45% to 55%, and a reduced crystalline size, compared with those of conventional poly-m-phenylene isophthalamide fibers.

The poly-m-phenylene isophthalamide fiber of the present invention preferably consists of a poly-m-phenylene isophthalamide alone. However, the m-phenylene isophthalamide polymer may consist of at least 95 molar %, preferably, at least 98 molar %, of recurring m-phenylene isophthalamide units and 5 molar % or less preferably 2 molar % or less of additional recurring units.

When the content of the additional recurring units is more than 5 molar %, the resultant fiber will exhibit an unsatisfactory degree of crystallinity and tensile strength.

The additional recurring units may contain an additional dicarboxyl acid component, for example, terephthalic acid, and an additional diamine component, for example, paraphenylenediamine or metaxylylenediamine.

The m-phenylene isophthalamide polymer usable for the present invention has an intrinsic viscosity ([η]) of 0.7 to 2.5, preferably, 1.2 to 2.0, determined at a concentration of 0.5 g/100 ml in N-methyl-2-pyrrolidone at a temperature of 30° C.

When the value of the intrinsic viscosity is less than 0.7, the resultant fiber will exhibit an unsatisfactory tensile strength even if the birefringence, degree of crystallinity, and crystalline size of the fiber are adjusted to the satisfactory values mentioned above. When the value of the intrinsic viscosity of the polymer is more than 2.5, the concentration of the polymer in the resultant spinning dope solution, which has an adequate viscosity and, thus, is usable for an ordinary wet spinning procedure, must be very small.

The polymer to be converted to the fiber of the present invention may contain one or more usual additives, for example, coloring matter, an ultraviolet ray-absorber, a light-stabilizer, and a flame-retardant.

The poly-m-phenylene isophthalamide fiber of the present invention exhibits a birefringence of from 0.18 to 0.22, preferably from 0.19 to 0.21, which represents a very high molecular orientation of the fiber; a degree of crystallinity of from 45% to 55%, preferably from 48% to 53%, which degree is remarkably higher than that of the conventional poly-m-phenylene isophthalamide fibers; and, a crystalline size of from 35 to 45 angstroms, preferably from 38 to 43 angstroms, which size is remarkably smaller than that of conventional poly-m-phenylene isophthalamide fibers.

When the birefringence is less than 0.18, the resultant fiber will have a poor degree of crystallinity of less than 48%, and thus an unsatisfactory mechanical strength.

If the refringence is more than 0.22, the resultant fiber will have an excessively high degree of crystallinity of more than 55%, and thus an undesirably low ultimate elongation and increased brittleness.

Also, if the degree of crystallinity is less than 45%, the resultant fiber will have an unsatisfactory mechanical strength. If the degree of crystallinity is more than 55%, the resultant fiber will exhibit an undesirably low ultimate elongation and increased brittleness.

Further, if the crystalline size is less than 35 Å, in the resultant fiber, the distinction between the crystalline regions and the amorphous regions will become unclear and the resultant fiber will exhibit a decreased dimensional stability. If the crystalline size is more than 45 Å, in the resultant fiber, the orientation of the crystals in the longitudinal direction of the fiber will be deteriorated and the resultant fiber will exhibit decreased physical properties.

In the poly-m-phenylene isophthalamide fiber of the presen invention, it was not expected that an impartment of the high orientation, the high crystallinity and the small crystalline size as specified above to the fiber would cause the resultant fiber to exhibit an enhanced tensile strength, which is about 20% higher than that of the conventional poly-m-phenylene isophthalamide fibers, without decreasing the ultimate elongation of the fiber.

Also, the inventors of the present invention have found through research that the poly-m-phenylene isophthalamide fiber of the present invention usually has a high degree of crystalline orientation of from 90% and 95%, which is considerably higher than that of the conventional poly-m-phenylene isophthalamide fibers.

The thickness and cross-sectional configuration of the poly-m-phenylene isophthalamide fiber of the present invention are not limited to a specific value and shape. But, the fiber of the present invention usually has a denier of from 1 to 10 and a regular round cross-sectional profile or an irregular, for example, elliptical, triangular, cocoon-shaped or hollow cross-sectional profile.

Due to the specific fine structure as mentioned above, the poly-m-phenylene isophthalamide fiber of the present invention has a high tensile strength of 6.5 g/denier or more, preferably 7.0 to 8.5 g/denier. In spite of the above-mentioned high tensile strength, the fiber of the present invention exhibits a preferable ultimate elongation of from about 20% to about 30%. Accordingly, the quantity of work necessary to break the fiber of the present invention by applying a tensile load thereto is larger than that of the conventional poly-m-phenylene isophthalate fibers. That is, a silk factor which represents the quantity of breaking work for the fiber of the present invention, is 35 or more.

Also, the poly-m-phenylene isophthalamide fiber of the present invention exhibits an excellent resistance to fibrillation thereof and is not fibrillated during use or processing, but conventional poly-p-phenylene terephthalamide fibers are easily fibrillated.

Furthermore, the poly-m-phenylene isophthalamide fiber of the present invention exhibits a superior heat resistance and, for example, a thermal shrinkage of 7% or less at a temperature of 300° C.

The poly-m-phenylene isophthalamide fiber of the present invention having the above-specified properties is produced by the process of the present invention. In this process, a dope solution of an m-phenylene isophthalamide polymer containing at least 95 molar % of recurring m-phenylene isophthalamide units and having an intrinsic viscosity of ([η]) 0.7 to 2.5, preferably, 1.2 to 2.0, determined at a concentration of 0.5 g/100 ml in dehydrated N-methyl-2-pyrrolidone at a temperature of 30° C. in an organic solvent, is extruded through a spinneret having at least one spinning orifice into a coagulating liquid. The resultant filamentary stream of the extruded dope solution comes into contact with the coagulating liquid and is coagulated therein to form undrawn polymer filaments.

Preferably, the dope solution is free from an inorganic salt, for example, calcium chloride. The presence of the inorganic salt in the dope solution means that the resultant filament must be washed under strict conditions, to completely remove the salt, and thus the filament-producing process becomes long and complicated.

The organic solvent usable for the dope solution preferably consists of at least one polar organic amide compound selected from the group consisting of N-methyl-2-pyrrolidone, N,N'-dimethylformamide and N,N'-dimethylacetamide.

The coagulating liquid usually consists of an aqueous solution of at least one inorganic salt, for example, calcium chloride, magnesium chloride or zinc chloride, and is used at a temperature of 60° C. to 100° C.

The wet spinning porcedure can be carried out under the conditions disclosed in detail in U.S. Pat. No. 4,073,837.

Referring to FIG. 1, the undrawn filament withdrawn from the coagulating liquid is subjected to a first solvent content-adjusting operation for adjusting the content of the organic solvent contained in the undrawn filament to a level of 15 to 30% based on the weight of the polymer in the filament. The first solvent content-adjusting operation may be carried out in a single step by using a single aqueous washing bath, or in two or more steps by using two or more aqueous washing baths.

The first solvent content-adjusted filament is subjected to a first wet drawing operation at a draw ratio of from 1.1 to 1.5. This first wet drawing operation can be carried out in a single step by using a single aqueous drawing bath, or in two or more steps by using two or more aqueous drawing baths.

The first wet drawn filament is subjected to a second solvent content-adjusting operation for adjusting the content of the organic solvent to a level of less than 15%, based on the weight of the polymer in the filament. This second solvent content-adjusting operation can be carried out in a single step by using a single aqueous washing bath, or in two or more steps by using two or more aqueous washing baths.

The second solvent content-adjusted filament is subjected to a second wet drawing operation at a draw ratio of 1.1 or more. This second wet drawing operation is carried out in a single step by using a single aqueous wet drawing bath, or in two or more steps by using two or more aqueous wet drawing baths.

The second wet drawn filament is dried and is then subjected to a dry drawing operation to an extent such that the entire draw ratio in the first and second wet drawing and dry drawing operations is in the range of from 4.0 to 7.0.

The dry drawn filament is subjected to a desired finishing operation, for example, winding up, heat-setting, or crimping.

In the first solvent content-adjusting operation, it is important that the content of the organic solvent contained in the undrawn filament be adjusted to a level of from 15% to 30% based on the weight of the polymer in the filament. When the content of the organic solvent is less than 15%, it will be difficult to satisfactorily draw the resultant filament in a washing water bath at a low temperature. Also, if the content of the organic solvent is more than 30%, the drawing procedure for the resultant filament will cause an undesirable flow of the molecules in the filament and, therefore, the degree of orientation of the molecules in the drawn filament will be poor.

The first solvent content-adjusting operation is usually carried out by bringing the undrawn filament into contact with at least one aqueous washing liquid containing 10% to 40% by weight of the same organic solvent as that contained in the dope solution, to adjust the content of the organic solvent in the filament to a desired level of from 15% to 30% and to control the crystallization rate and the crystal-growing rate of the filament. The first aqueous washing liquid preferably has a temperature of 20° C. to 70° C.

In the first wet drawing operation, the first solvent content-adjusted filament is drawn in at least one aqueous wet drawing bath while the content of the organic solvent remaining in the filament is reduced to a level of not less than 15% based on the weight of the polymer in the filament. In order to control the reducing rate of the organic solvent content in the filament, the first aqueous wet drawing bath contains the same organic solvent as that contained in the dope solution, and therefore in the filament, in a concentration of 3 to 30% by weight. Also, the temperature of the first wet drawing operation is preferably in the range of from 50° C. to 95° C., more preferably from 60° C. to 90° C. The first wet drawing operation is carried out in a single step, or in two or more steps so that the total draw ratio in the two or more drawing steps falls in a range of from 1.1 to 1.5.

If the total draw ratio is less than 1.1, the resultant drawn filament exhibits an unsatisfactory crystalline structure, molecular orientation, and tensile strength.

If the total draw ratio is more than 1.5, the resultant drawn filament will exhibit an undesirably low degree of orientation, because a flow of the molecules in the filament will preferentially occur in the drawing procedure.

In a preferable first wet drawing operation, the first solvent content-adjusted filament is drawn, in a first step, in a first aqueous wet drawing bath containing 10 to 30% by weight of the same organic solvent as that contained in the dope solution, and thus in the filament, at a draw ratio of 1.1 to 1.4 at a temperature of 50° C. to 70° C. and then, in a second step, in a second aqueous wet drawing bath containing the same organic solvent as that mentioned above in a concentration of 5% to 15% by weight but not more than that in the first aqueous wet drawing bath, at a draw ratio necessary to obtain the total draw ratio of 1.1 to 155, at a temperature of 70° C. to 90° C. It was confirmed that the first wet drawing operation can be smoothly carried out under the above-described conditions, and that the final filament having a satisfactory quality can be obtained from the resultant first drawn filament.

In the second solvent content-adjusting operation, the content of the organic filament in the first wet drawn filament is adjusted, in a single step or in two or more steps, to a level of less than 15% based on the weight of the polymer in the filament.

If the content of the organic solvent in the second solvent content-adjusted filament is more than 15%, the resultant filament from the second wet drawing procedure will exhibit an undesirably low degree of orientation and the crystallization of the filament in the next dry drawing procedure will be poor. The second solvent content-adjusting operation is carried out by bringing the first wet drawn filament into contact with at least one second aqueous washing liquid. The second aqueous washing liquid may consist of water alone or a small amount of an aqueous solution, for example, 10% by weight or less, of the same organic solvent as that contained in the dope solution or the filament.

The second aqueous washing liquid preferably has a temperature of 60° C. to 90° C.

The second solvent content-adjusted filament is subjected to a second wet drawing operation, which is carried out at a draw ratio of 1.1 or more, preferably 1.5 to 3.0 in at least one second aqueous wet drawing bath. The second wet drawing operation may be carried out while the organic solvent remaining in the filament is removed.

The one or more second aqueous drawing bath consists of water alone or an aqueous solution of the same organic solvent as that in the dope solution, and thus in the filament, at a concentration of 10% by weight or less. The second wet drawing operation is preferably carried out, in a single step or in two or more steps, at a temperature of 90° C. to 100° C. During the second wet drawing operation, a washing operation may be carried out at a temperature of 90° C. to 100° C. in at least one aqueous washing bath consisting of water alone.

Preferably, the second wet drawing operation is followed by a final washing operation in an aqueous washing bath consisting of water alone, to completely remove the organic solvent from the filament.

The second drawn filament or washed filament is dried by an ordinary method at a temperature of from 100° C. to 140° C.

The dried filament is subjected to a dry drawing operation to an extent such that the entire draw ratio in the first and second wet drawing and dry drawing operations falls within a range of from 4.0 to 7.0, preferably, 4.5 to 6.5. Preferably, the dry drawing operation is carried out at a temperature of 300° C. to 400° C. on a heating plate or in a heating oven, at a draw ratio of 1.5 to 2.5.

If the entire draw ratio is less than 4.0, the resultant filament will exhibit an unsatisfactory tensile strength of less than 6.5 g/denier. Also, if the entire draw ratio is more than 7.0, the drawing operations sometimes cause the filament to be ruptured.

The poly-m-phenylene isophthalamide fiber of the present invention has an excellent tensile strength of 6.5 g/denier or more, which is about 20% or more higher than that of conventional poly-m-phenylene isophthalamide fibers, a satisfactory ultimate elongation, and an excellent heat resistance. Therefore, the fiber of the present invention can be utilized for various fields, in which the conventional poly-m-phenylene isophthalamide fibers are not utilized due to the low tensile strength thereof, for example, reinforcing materials for rubber products and synthetic resin products, and substrate fabrics for bag filter felts.

Also, in some fields in which the conventional poly-m-phenylene isophthalamide fibers are utilized, the fibers of the present invention can be used in a reduced amount to produce a product having the same quality as that of the conventional fibers. That is, the fiber of the present invention is useful in that the products can be made lighter and smaller than the conventional products.

Furthermore, since the fiber of the present invention exhibits a higher initial tensile strength than that of the conventional fibers, and the same level of tensile strength-maintainability at a high temperature as that of the conventional fibers, a product, for example, a bag filter, made of the fiber of the present invention exhibits an enhanced durability during filtering operations.

The poly-m-phenylene isophthalamide fiber of the present invention is produced by the process of the present invention by stabilized procedures and at an improved efficiency.

The present invention will be further explained by way of specific examples, which, however, are representative and do not restrict the scope of the present invention in any way.

In the examples, the following tests were carried out.

(A) Intrinsic viscosity

The intrinsic viscosity of an m-phenylene isophthalamide polymer or fibers thereof was determined at a concentration of 0.5 g/100 ml in a solvent consisting of dehydrated N-methyl-2-pyrrolidone at a temperature of 30° C.

The intrinsic viscosity of the polymer is represented by $[\eta]$, and that of the fibers is represented by $[\eta]_f$.

(B) Degree of crystallinity

The degree of crystallinity of a fiber was determined by the standard X-ray diffraction method.

The calculation of crystalline regions and non-crystalline regions was carried out as follows.

(1) The value of the scattering angle, $2\theta$, was in the range of from 12° to 32°.

(2) A straight base line was drawn between $2\theta=17°$ and $2\theta=30°$. A non-crystalline scattering curve for the non-crystalline regions consisted of the above-mentioned straight line and a meridional diffraction curve between $2\theta<17°$ and $2\theta>30°$. The area (C) of the region between the non-crystalline scattering curve and a non-orientation approximate curve corresponded to a contribution of the crystalline regions. Also, the area (A) of the region between the non-crystalline scattering curve and an air scattering curve corresponds to a contribution of the non-crystalline regions.

The degree of crystallinity (%) is calculated in accordance with the following equation.

$$\textit{Degree of Crystallinity}\ (\%)=C/T(1-12.7/100)\times 100$$

wherein $T=A+C$.

(C) Crystalline size

The crystalline size was determined in accordance with the method for determining the apparent crystalline size (ACS) described in Japanese Examined Patent Publication (Kokoku) No. 61-3886, columns 12 to 13.

(D) Degree of crystalline orientation

This was determined by the standard simplified method with reference to Japanese Examined Patent Publication (Kokoku) No. 61-3886, columns 13 to 14. The poly-m-phenylene isophthalamide has a (110) reflection at $2\theta=27.3°$ at the strongest peak point on an equator.

The degree of crystalline equation was calculated in accordance with the following equation.

$$\textit{Degree of crystalline orientation}\ (\%)=(180°-H°/180°)\times 100$$

wherein H represents a half value width.

(E) Tensile strength and ultimate elongation

Those items were determined in accordance with Japanese Industrial Standard (JIS) L-1015-1983, Test Method for Chemical Staple Fibers.

(F) Silk factor

This was determined in accordance with the following equation.

$$\text{Silk factor} = S \times \sqrt{E}$$

wherein S represents a tensile strength in g/denier and E represents an ultimate elongation in %.

EXAMPLE 1

An m-phenylene isophthalamide homopolymer produced in accordance with the interface polymerization method described in Japanese Examined Patent Publication (Kokoku) No. 47-10863, which corresponded to U.S. Pat. No. 3,640,970, and having an intrinsic viscosity $[\eta]$ of 1.45 was dissolved at a concentration of 20.5% by weight in a solvent consisting of N-methyl-2-pyrrolidone, to provide a dope solution.

The dope solution was subjected to the wet spinning process described in Japanese Examined Patent Publication (Kokoku) No. 48-17551 in which a spinneret having 10,000 spinning orifices having a diameter of 0.07 mm and a coagulating liquid containing 45% by weight of calcium chloride dissolved in water and having a temperature of 90° C. were used.

The coagulated, undrawn filaments withdrawn from the coagulating liquid contained 45% of the solvent based on the weight of the polymer in the filaments.

The undrawn filaments were washed by a first solvent content-adjusting liquid containing 30% by weight of the solvent dissolved in water at a temperature of 30° C. to carry out a first adjustment of the content of the solvent in the filaments to a value of 25% based on the weight of the polymer in the filaments.

The first solvent content-adjusted filaments were subjected to a first wet drawing operation in two steps as shown in Table 1.

TABLE 1

| First Wet Drawing Operation | | | |
|---|---|---|---|
| | | Step No. | |
| Item | | Step No. 1 | Step No. 2 |
| Aqueous wet drawing bath | Concentration of solvent (% wt.) | 20 | 10 |
| | Temperature (°C.) | 60 | 70 |
| Draw ratio | | 1.1 | 1.2 |

The first wet drawn filaments were washed with water at a temperature of 50° C. to carry out a second adjustment of the content of the solvent remaining in the filaments to a level of 10% based on the weight of the polymer in the filaments.

The second solvent content-adjusted filaments were second wet drawn at a draw ratio of 2.1 in a wet drawing bath consisting of water at a temperature of 90° C.

The second wet drawn filaments were dried at a temperauure of 120° C. The dried filaments, which are substantially free from the solvent, were subjected to a dry drawing operation at a draw ratio of 1.7 at a temperature of 350° C. by means of a heat drawing plate.

The entire draw ratio was 4.7.

The results of the tests are shown in Table 2.

Comparative Example 1

The same procedures as those described in Example 1 were carried out with the following exception.

The poly-m-phenylene isophthalamide used had an intrinsic viscosity [η] of 1.35. The undrawn filaments were washed with water at a temperature of 60° C. to adjust the content of the solvent in the filaments to a value of 8%, and then were wet drawn at a draw ratio of 2.4 in a wet drawing bath consisting of water at a temperature of 95° C., were dried at a temperature of 130° C., and were finally dry drawn at a draw ratio of 1.75 in the same manner as that described in Example 1.

The test results are indicated in Table 2.

TABLE 2

| | Example No. | |
|---|---|---|
| Item | Example 1 | Comparative Examaple 1 |
| Individual filament denier | 2 | 2 |
| $[\eta]_f$ | 1.45 | 1.35 |
| Birefringence | 0.190 | 0.152 |
| Degree of crystallinity (%) | 50 | 41 |
| Crystalline size (Å) | 42 | 48 |
| Degree of crystalline orientation (%) | 92 | 89 |

TABLE 2-continued

| | Example No. | |
|---|---|---|
| Item | Example 1 | Comparative Examaple 1 |
| Tensile strength (g/d) | 7.2 | 5.5 |
| Ultimate elongation (%) | 30 | 37 |
| Silk factor | 39.4 | 33.5 |
| Thermal shrinkage at 300° C. | 5.5 | 5.5 |

As Table 2 clearly indicates, the poly-m-phenylene isophthalamide fibers of Comparative Example 1, which fibers are similar to the conventional poly-m-phenylene isophthalamide fibers, had a tensile strength of 5.5 g/denier and a silk factor of 33.5, but the fibers of Example 1 in accordance with the present invention exhibited an excellent tensile strength of 7.2 g/denier and a superior silk factor of 39.4.

When the fibers of Example 1 were converted to a substrate cloth of a bag filter felt, it was found that the resultant bag filter had a higher durability than that of the conventional fibers.

EXAMPLE 2

A poly-m-phenylene isophthalamide having a intrinsic viscosity [η] of 1.35 was produced in accordance with the interface polymerization method described in Japanese Examined Patent Publication (Kokoku) No. 47-10863. The polymer was dissolved at a concentration of 22% by weight in a solvent consisting of N-methyl-2-pyrrolidone. The resultant dope solution was subjected to the wet-spinning process described in Japanese Examined Patent Publication (Kokoku) No. 48-17551 in which the spinneret had 6,000 spinning orifices having a diameter of 0.08 mm and the coagulating liquid contained 43% by weight of calcium chloride dissolved in water and had a temperature of 95° C.

The undrawn filaments contained 43% of the solvent based on the weight of the polymer in the filaments. The undrawn filaments were washed with an aqueous washing liquid containing 30% by weight of the solvent at a temperature of 40° C. to carry out a first adjustment of the content of the solvent in the filaments to a value of 23% by weight.

The first solvent content-adjusted filaments were first wet drawn in two steps under the conditions shown in Table 3.

TABLE 3

| | | Step No. | |
|---|---|---|---|
| Item | | Step No. 1 | Step No. 2 |
| Wet drawing liquid | Concentration of solvent (%) | 10 | 7 |
| | Temperature (°C.) | 45 | 60 |
| Draw ratio | | 1.1 | 1.2 |

The first wet drawn filaments were washed with a washing liquid consisting of water alone to carry out a second adjustment of the content of the solvent remaining in the filament to a value of 12% by weight or less.

The second solvent content-adjusted filaments were second wet drawn in a wet drawing liquid consisting of water alone at a draw ratio of 2.2 at a temperature of 90° C.

The second wet drawn filaments were further washed with a washing liquid consisting of hot water alone at a temperature of 90° C., without drawing.

The washed filaments were dried at a temperature of 120° C., and then were dry drawn at a draw ratio of 1.70 by means of a heat drawing plate at a temperature of 355° C.

The entire draw ratio was 4.9.

The test results are indicated in Table 5.

EXAMPLES 3 TO 5 AND COMPARATIVE EXAMPLE 2

In each of Examples 3 to 5 and Comparative Example 2, the same procedures as those described in Example 2 were carried out except that the intrinsic viscosity [η] of the polymer used, the concentration of the polymer in the dope solution, and the concentrations of the solvent in the first and second washing baths were as shown in Table 4 and the first and second wet drawing operations and the dry drawing operation were carried out under the conditions shown in Table 4.

The test results are shown in Table 4.

TABLE 4

| Item | | Example No. Example 3 | 4 | 5 | Comparative Example 2 |
|---|---|---|---|---|---|
| IV of polymer | | 1.30 | 1.40 | 1.35 | 1.35 |
| Concentration of polymer in dope solution (%) | | 22 | 21 | 22 | 22 |
| Content of solvent in first solvent content-adjusted filament (%) | | 23 | 24 | 22 | 22 |
| First wet drawing operation | Step No. 1 | | | | |
| | Temp. (°C.) | 45 | 60 | 60 | 65 |
| | Conc. of solvent (%) | 15 | 20 | 30 ($CaCl_2$) | — |
| | Draw ratio | 1.1 | 1.0* | 1.1 | 1.0* |
| | Step No. 2 | | | | |
| | Temp. (°C.) | 60 | 70 | 40 | 65 |
| | Conc. of solvent (%) | 10 | 10 | 10 ($CaCl_2$) | — |
| | Draw ratio | 1.1 | 1.2 | 1.3 | 1.0* |
| Content of solvent in second solvent content-adjusted filaments | | 13 | 12 | 14 | 8 |
| Second wet drawing operation | Step No. 1 | | | | |
| | Temp. (°C.) | 85 | 90 | 90 | 90 |
| | Draw ratio | 2.1 | 2.3 | 2.0 | 2.4 |
| | Step No. 2 | | | | |
| | Temp. (°C.) | 90 | 90 | 90 | 90 |
| | Draw ratio | 1.1 | 1.0* | 1.0* | 1.0* |
| Dry drawing operation | | | | | |
| Temperature (°C.) | | 355 | 350 | 355 | 350 |
| Draw ratio | | 1.72 | 1.75 | 1.75 | 1.75 |

Note:
*The filaments were washed without drawing.

EXAMPLE 6

A reaction vessel having a capacity of 2 $m^3$ and equipped with a stirrer, a cooling coil, and a cooling jacket, was charged with a solution of 213.18 kg of isophthalic acid chloride (IPC) having a purity of 99.95% in 750 l of dehydrated tetrahydrofuran (THF) containing 100 ppm of water. The solution was cooled to a temperature of −22° C. while being stirred at a stirring rate of 300 r.p.m.

Separately, a dissolving vessel having a capacity of 1 $m^3$ and equipped with a stirrer, a cooling coil, and a cooling jacket was charged with a solution of 113.55 kg of m-phenylene diamine (MPDA) having a purity of 99.93% in 750 l of dehydrated THF having a water content of 100 ppm. The solution was cooled to a temperature of −22° C. The cooled MPDA solution in THF was mixed into the cooled IPC solution in THF at an addition rate of 4.3 l/min in a time of 200 minutes in such a manner that the MPDA solution was sprayed through a number of spray nozzles to form fine particles of the solution having a size of 0.1 mm or less, while the IPC solution was stirred. A white milky mixture liquid having a temperature of −15° C. was obtained. After the mixing operation was completed, the mixture liquid was further stirred for about 5 minutes.

A reaction vessel having a capacity of 5 $m^3$ and equipped with a high speed stirrer was charged with a solution of 156 kg of sodium carbonate in 1750 l of water. While the sodium carbonate solution was stirred at a stirring rate of 1700 rpm, the white milky mixture liquid was rapidly added to the sodium carbonate solution, and the resultant reaction mixture was further stirred for about 5 minutes.

During the above-mentioned stirring operation, the viscosity of the reaction mixture increased a few minutes after the start of the addition operation, and then decreased. A white suspension was obtained, and the resultant suspension was filtered to collect a white powder. The collected white powder was washed with water and then dried. A white poly-m-phenylene isophthalamide powder was obtained in an amount of 249.4 kg, at a yield of 99.8%.

The polymer had an [η] of 2.0.

The molecular weight distribution of the polymer was determined by high speed liquid chromatography, and it was found that the polymer contained 96.9% of a high molecular weight fraction (A), no low molecular weight fraction (B), and 3.1% of oligomer (C). That is, the polymer had a very high content of the high molecular weight fraction (A).

The polymer was dissolved at a concentration of 18% by weight in a solvent consisting of N-methyl-2-pyrrolidone.

The resultant dope solution was subjected to the same wet spinning procedure as those described in Example 2.

The coagulated, undrawn filaments contained 45% by weight of the solvent based on the weight of the polymer in the filaments.

The undrawn filament was first washed with a first washing liquid containing 30% by weight of the solvent dissolved in water at a temperature of 30° C. to carry out a first adjustment of the content of the solvent in the filament to a level of 24%.

The first solvent content-adjusted filaments were first wet drawn in two steps under the following conditions. In the first step, the filaments were wet drawn at a draw ratio of 1.1 in a wet drawing bath consisting of an aqueous solution of 20% by weight of the solvent at a temperature of 45° C. Then, in the second step, the filaments were further wet drawn at a draw ratio of 1.2 in a wet drawing bath consisting of an aqueous solution of 15% by weight of the solvent at a temperature of 50° C.

The first wet drawn filaments were given a second washing with a second washing liquid consisting of water alone at a temperature of 70° C. to carry out a second adjustment of the content of the solvent in the filaments to a level of 14% based on the weight of the polymer in the filaments.

The second washed filaments were second wet drawn in two steps as follows.

In the first step, the filaments were wet drawn at a draw ratio of 2.1 in a wet drawing bath consisting of hot water alone at a temperature of 80° C.

In the second step, the filaments were further wet drawn at a draw ratio of 1.1 in a wet drawing bath consisting of hot water alone at a temperature of 90° C.

The second drawn filaments were dried at a temperature of 130° C., and then were dry drawn at a draw ratio of 1.70 at a temperature of 355° C. by means of a heat drawing plate.

The test results are shown in Table 5.

TABLE 5

| Item | Example No. Comparative Example 2 | Example 2 | 3 | 4 | 5 | 6 |
|---|---|---|---|---|---|---|
| Individual filament denier | 2 | 2 | 2 | 2 | 2 | 2 |
| [η] | 1.35 | 1.35 | 1.30 | 1.40 | 1.35 | 2.0 |
| Birefringence (%) | 0.16 | 0.20 | 0.19 | 0.20 | 0.21 | 0.21 |
| Degree of crystallinity (%) | 41 | 51 | 50 | 50 | 52 | 53 |
| Crystalline size (Å) | 48 | 40 | 41 | 41 | 39 | 37 |
| Degree of crystalline orientation | 88 | 93 | 92 | 92 | 93 | 94 |
| Tensile strength (g/d) | 5.3 | 7.8 | 7.5 | 7.6 | 8.1 | 8.2 |
| Ultimate elongation (%) | 37 | 26 | 28 | 27 | 25 | 25 |
| Silk factor | 32.2 | 39.8 | 39.7 | 39.5 | 40.5 | 41.0 |
| Thermal shrinkage at 300° C. | 6.0 | 6.0 | 5.8 | 5.6 | 5.9 | 5.8 |

EXAMPLE 7

A solution of 213.18 kg of isophthalic acid chloride (IPC) having a purity of 99.95% in 750 l of tetrahydrofuran (THF) having a water content of 100 ppm was prepared in a reaction vessel having a capacity of 2 $m^3$ and equipped with a stirrer, a cooling coil, and a cooling jacket and was cooled to a temperature of −10° C. while the solution was stirred at a stirring rate of 300 r.p.m. Separately, a solution of m-phenylenediamine (MPDA) having a purity of 99.93% in 750 l of THF having a water content of 100 ppm was prepared in a dissolving vessel having a capacity of 1 $m^3$ and equipped with a stirrer, a cooling coil, and a cooling jacket, and was cooled to a temperature of −15° C. while stirring.

The cooled MPDA/THF solution was added to the cooled IPC/THF solution at a adding rate of 8.5 l/min in a time of 120 minutes, while the cooled MPDA/THF solution was sprayed through a number of nozzles so that the solution aas formed into fine particles having a size of 0.1 mm or less, and while the cooled IPC/THF solution was stirred. A white milky mixture liquid having a temperature of −4° C. was obtained. Ten minutes after the addition operation was completed, 450 l of aniline was added to the milky mixture while the mixture was stirred. Separately, a solution of 195 kg of sodium carbonate in 1750 l of water was charged into a reaction vessel having a capacity of 5 $m^3$ and equipped with a high speed stirrer, and was stirred at a stirring rate of 1700 r.p.m. The milky mixture was rapidly added to the sodium carbonate solution, 15 minutes after the addition of aniline was completed. The resultant reaction mixture was stirred for about 5 minutes. A few seconds after the start of the addition, the viscosity of the reaction mixture increased and then decreased, and a white suspension was obtained. The white suspension was filtered to collect a white polymer powder, and the collected powder was washed with water and dried. A white polymer powder was obtained in an amount of 249.2 kg at a yield of 99.7%.

The polymer had an [η] of 1.32. In the polymer, the terminals thereof were blocked by aniline in a proportion of 26%, and the polymer contained 4% by weight of oligomer.

The above-mentioned polymerization procedures were repeated ten times. The average value ($\bar{x}$) of the intrinsic viscosity of the resultant polymer was 1.32 with a variability ($\sigma$) of 0.03. That is, the polymer had a preferable value of intrinsic viscosity for fiber-forming and the variability of the viscosity was small.

The same procedures as those described in Example 2 were carried out by using the above-mentioned polymer having the aniline-blocked terminals.

The resultant fibers had an individual filament denier of 2, a birefringence of 0.20, a degree of crystallinity of 51%, a crystalline size of 39 Å, a degree of crystalline orientation of 93%, a tensile strength of 7.8 g/denier, an ultimate elongation of 26%, a silk factor of 39.8, and a thermal shrinkage at 300° C. of 5.8%.

After the fibers were dry heated at a temperature of 300° C. for 20 hours, the percentage of the tensile strength of the heated fibers to the original fibers was 94%.

We claim:

1. A process for producing a high strength poly-m-phenylene isophthalamide fiber having a birefringence of from 0.18 to 0.22, a degree of crystallinity of from 45% to 55%, a crystalline size of from 35 to 45 angstroms, a tensile strength of 6.5 g/denier or more and a silk factor of 35 or more, comprising the steps of;

extruding a dope solution of an m-phenylene isophthalamide polymer containing at least 95 molar % of recurring m-phenylene isophthalamide units and having an intrinsic viscosity ([η]) of from 0.7 to 2.5, determined at a concentration of 0.5 g/100 ml in dehydrated N-methyl-2-pyrrolidone at a temperature of 30° C., in an organic solvent through a spinneret having at least one spinning orifice, into a coagulating liquid to form at least one undrawn polymer filament;

making a first adjustment of the content of the organic solvent in the undrawn filament to a level of from 15% to 30% based on the weight of the polymer in the filament;

carrying out a first wet drawing of the first organic solvent content-adjusted undrawn filament at a draw ratio of from 1.1 to 1.5 in at least one aqueous wet drawing bath;

making a second adjustment of the content of the organic solvent in the filament to a level of less than 15% based on the weight of the polymer in the filament;

carrying out a second wet drawing of the second organic solvent content-adjusted filament at a draw ratio of 1.1 or more in at least one aqueous wet drawing bath;

drying the second wet drawn filament; and dry drawing the dried filament to an extent such that the entire draw ratio in the first and second wet drawing and dry drawing operations is in the range of from 4.0 to 7.0.

2. The process as claimed in claim 1, wherein the organic solvent consists of at least one member selected from the group consisting of N-methyl-2-pyrrolidone, N,N-dimethylacetamide, and N,N-dimethylformamide.

3. The process as claimed in claim 1, wherein the first organic solvent content-adjusting operation is carried out, in at least one step, by bringing the filament into contact with at least one first aqueous washing liquid containing 10% to 40% by weight of the same organic solvent as that contained in the dope solution.

4. The process as claimed in claim 1, wherein the first organic content-adjusting operation is carried out at a temperature of from 20° C. to 70° C.

5. The process as claimed in claim 1, wherein the first wet drawing operation is carried out while the content of the organic solvent remaining in the filament is reduced to a level of not less than 15% based on the weight of the polymer in the filament.

6. The process as claimed in claim 1, wherein the first wet drawing operation is carried out at a temperature of from 50° C. to 95° C.

7. The process as claimed in claim 1, wherein the at least one aqueous drawing bath contains the same organic solvent as that contained in the dope solution in a concentration of 3 to 30% by weight.

8. The process as claimed in claim 1, wherein the first wet drawing operation is carried out in two steps, in a first aqueous wet drawing bath containing 10 to 30% by weight of the same organic solvent as that contained in the dope solution, at a draw ratio of 1.1 to 1.4 at a temperature of 50° C. to 70° C., and then in a second aqueous wet drawing bath containing the same organic solvent as that contained in the dope solution, in a concentration of 5% to 15% by weight but not more than that of the first aqueous wet drawing bath, at a draw ratio necessary to obtain the total draw ratio of 1.1 to 1.5, at a temperature of 70° C. to 90° C.

9. The process as claimed in claim 1, wherein the second organic solvent content-adjusting operation is carried out, in at least one step, by bringing the filament into contact with at least one second aqueous washing liquid.

10. The process as claimed in claim 1, wherein the second organic solvent content-adjusting operation is carried out at a temperature of 60° C. to 100° C.

11. The process as claimed in claim 1, wherein the second wet drawing operation is carried out at a draw ratio of 1.5 to 3.0.

12. The process as claimed in claim 1, wherein the second wet drawing operation is carried out while the organic solvent remaining in the filament is removed in the at least one aqueous wet drawing bath.

13. The process as claimed in claim 1, wherein the second wet drawing operation is carried out at a temperature of from 50° C. to 95° C.

14. The process as claimed in claim 1, wherein the dry drawing operation is carried out at a temperature of from 300° C. to 400° C.

15. The process as claimed in claim 1, wherein the dry drawing operation is carried out at a draw ratio of 1.5 to 2.5.

16. The process as claimed in claim 1, wherein the second wet drawing operation is followed by at least one final washing operation.

* * * * *